US005582533A

United States Patent [19]

McPherson

[11] Patent Number: 5,582,533

[45] Date of Patent: Dec. 10, 1996

[54] METHOD OF MANUFACTURING PLASTIC FINGERNAIL TIP EXTENSION

[76] Inventor: Robert McPherson, 408 S. Saginaw, Flint, Mich. 48503

[21] Appl. No.: 421,137

[22] Filed: Apr. 13, 1995

Related U.S. Application Data

[63] Continuation-in-part of Ser. No. 134,437, Oct. 12, 1993, abandoned.

[51] Int. Cl.[6] ..... B24B 1/00

[52] U.S. Cl. ..... 451/32; 451/36

[58] Field of Search ..... 132/73, 73.4, 73.6; 451/32, 36, 85

[56] References Cited

U.S. PATENT DOCUMENTS

| | | | |
|---|---|---|---|
| 3,916,920 | 11/1975 | Tsukamoto | 51/206 R |
| 4,157,095 | 6/1979 | Sweet | 132/73 |
| 4,213,471 | 7/1980 | Burian et al. | 132/73.6 |
| 4,534,138 | 8/1985 | Pangburn | 51/392 |
| 4,625,740 | 12/1986 | Roth | 132/73 |
| 4,671,305 | 6/1987 | Mann | 132/73 |
| 5,060,678 | 10/1991 | Bauman et al. | 132/73 |
| 5,287,863 | 2/1994 | La Joie et al. | 132/73.4 |

*Primary Examiner*—Timothy V. Eley
*Attorney, Agent, or Firm*—Donald C. Bolger, P.C.

[57] ABSTRACT

A process for modifying commercial/domestic plastic fingernail tip extensions comprises the steps of, loading an abrasive material with a plurality of commercial/domestic plastic fingernail tip extensions into a mixing chamber whereby a plurality of fingernail tip extensions are processed simultaneously either by blowing gas through the mixing chamer in combination with an abrasive material, tumbling the mixing chamber, or vibrating the mixing chamber, to scratch/roughen the commercial/domestic plastic fingernail tip extensions to a desired thickness.

3 Claims, 1 Drawing Sheet

METHOD OF MANUFACTURING PLASTIC FINGERNAIL TIP EXTENSION

This is a continuation-in-part of application Ser. No. 08,134,437 filed on Oct. 12, 1993 now abandoned.

BACKGROUND OF THE INVENTION

The field of the invention is generally that of care and maintenance of natural fingernails, and more specifically, to an improved process for preparing the outer surface of a commercial/domestic plastic artificial fingernail tip extension.

It is considered fashionable and enhancing to have long, well cared for fingernails. Long commercial/domestic plastic artificial fingernail tip extensions project beyond the tip of the natural finger nail. If regular natural fingernails are left to grow, the natural fingernail tip usually splits, cracks, or is broken and therefore longer commercial/domestic plastic artificial fingernail tip extensions are easier to care for and much better than natural fingernails. Various methods have been used to attach commercial/domestic plastic artificial fingernail tip extensions.

One method is called a "sculptured fingernail tip extension" process whereby a mask having a cut-out conforming to the length and shape of the desired fingernail extension is placed around the natural fingernail and a paste-like coating of material is applied, which hardens and forms an artificial fingernail extension conforming to the shape of the cut-out. The sculptured fingernail tip extension binds by adhesion to the tip of the natural fingernail.

Another method involves attaching a preformed commercial/domestic manufactured artificial fingernail tip extension to the surface of the natural fingernail with an adhesive substance and then blended to the natural fingernail to form a natural looking fingernail to achieve the desired length and shape and a smooth finish. Typically, a "wrap" material, which, for example, may be comprised of a thin layer of paper, fiberglass, linen or silk, is attached to the natural fingernail using an adhesive material after the artificial commercial/domestic plastic tip extension and natural fingernails are joined together. The wrap material is then filled into the surface of the fingernail to provide a more natural-looking, translucent fingernail and to strengthen the attachment of the natural and artificial commercial/domestic plastic tip extensions.

Other methods provide an adhesive as a filler which attaches the artificial commercial/domestic plastic fingernail tip extension to the natural fingernail. Artificial commercial/domestic fingernail tip extensions are made of ABS plastic and with a smooth oily shinny surface. This smooth shinny oily surface must be removed by the nail technician or general public, by hand, with a file, or emery board before acrylic or gels or other fillers can be applied to the commercial/domestic plastic fingernail tip extension. The present invention solves the problem of removing the smooth oily shinny factory finish of the commercial/domestic plastic fingernail tip extension by presently being removed by hand with a file or emery board and providing a rough scratchy surface which increases the speed of the commercial/domestic plastic fingernail tip extension applications.

Presently, most nail technicians and the general public prepare commercial/domestic plastic tip extensions by filing after applying to the natural fingernail. This filing is to roughen the commercial/domestic plastic fingernail tip extension and is often time consuming and not uniform culminating in weak spots in the overall structure when completed. This process can take up to a minute for each fingernail or 10 to 20 minutes for each customer. The present invention, eliminates this fingernail filing step in the technicians general public process by providing pre-roughened commercial/domestic plastic fingernail tip extensions that will not need to be filed. Many commercial/domestic vendors sell plastic or ABS artificial nail tip extensions, but all are of a smooth oily shinny finish type. The present invention is the first to discover that prefinished roughened commercial/domestic plastic fingernail tip extensions can increase productivity drastically, making the job easier for the nail technician general public, resulting in higher productivity and higher quality results when finished. Furthermore, during the roughing process the entire surface top, bottom, well area, and all sides are pre-roughened making the adhesion time to the natural nail tip quicker. This results in a stronger, longer lasting bond which is due to the roughening process. This also saves time and produces overall better results than the smooth oily commercial nail tip extensions. The smooth oily commercial nail tip extensions do not adhere well in very humid weather conditions.

SUMMARY OF THE INVENTION

Generally speaking, the present invention comprises a process to roughen/scratch the surface of the commercial/domestic plastic fingernail tip extension by etching, sanding, scratching, sandblasting, tumbling, vibration, and other means. The present invention eliminates the need for the nail technician or general public to file the commercial/domestic plastic fingernail tip extension, by pre-roughening the commercial/domestic plastic fingernail tip extension before applying to the natural finger nail tip.

It is an object of the present invention to provide a process which allows commercial/domestic plastic fingernail tip extensions to be applied faster than present methods.

It is a further object of the invention to provide a novel process to roughen/scratch commercial/domestic plastic fingernail tip extensions evenly over all parts of the commercial/domestic plastic fingernail tip extensions in order to achieve the quicker set time when gluing the tips on the natural nail and to achieve a uniform roughing for greater strength retention.

It is another object of the invention to provide a novel process to prepare and prefinish commercial/domestic plastic fingernail tip extensions prior to the time of its use to save nail technicians and general public time when applying the commercial/domestic plastic fingernail tip extension and increase productivity.

It is a further object of the invention to provide a novel process to roughen/scratch commercial domestic plastic fingernail tip extensions in mass by tumbling, or etching, or sanding, or sand blasting, or scratching, or other surface roughen techniques. In order to alter the thickness of the commercial/domestic plastic artificial fingernail tip extension to a point that blending to the natural nail by hand can be eliminated, saving the time during the application process.

It is another object of the invention to provide a low cost process for preparing a commercial/domestic plastic fingernail tip extensions so that the step of filing by hand the entire commercial/domestic plastic fingernail tip extensions can be eliminated from the nail technicians procedure in applying the commercial/domestic plastic fingernail tip extensions.

Further objects are implicit in the detailed description which follows hereinafter (which is to be considered as exemplary of, but not specifically limiting, the present invention) and said objects will be apparent to persons skilled in the art after a careful study of the detailed description which follows.

For the purpose of clarifying the nature of the present invention, one exemplary embodiment of the invention is illustrated in the hereinbelow-described figure of the accompanying drawing and is described in detail hereinafter. It is to be taken as representative of the multiple embodiments of the invention which lie within the scope of the invention.

DESCRIPTION OF THE PREFERRED EMBODIMENTS

Figure 1:
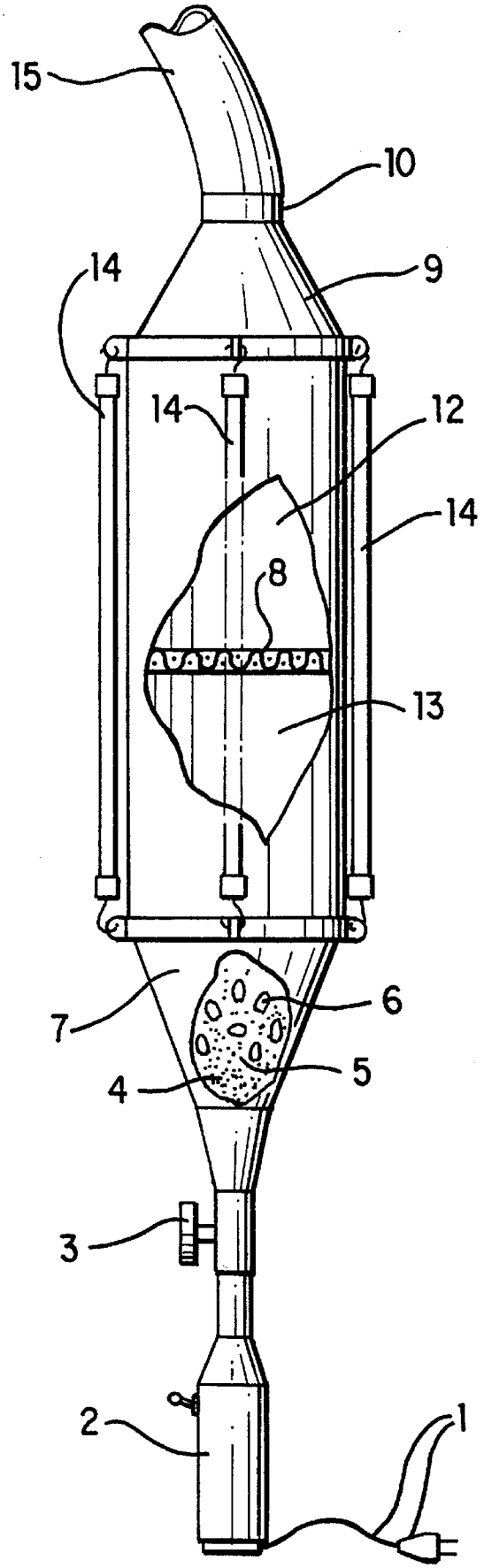
FIG. 1 is a process showing one exemplary embodiment of one representative form of the invention.

Referring to FIG. 1, these and other objectives are accomplished in accordance with the present invention whereby a method of roughening/scratching commercial/domestic plastic fingernail tip extensions before applying to a natural fingernail.

Referring to FIG. 1, chamber 7 is connected to on/off valve 3 and on/off valve 3 is connected to blower 2. Blower 2 has electrical cord 1 which is plugged into an electrical outlet. Lower chamber 4 supports white aluminum oxide 5, however, other abrasive material can also be used. Commercial/domestic plastic fingernail extensions 6 are placed on top of the white aluminum oxide 5. Seal area 8 allows access to load and unload commercial/domestic plastic fingernail extensions 6. Cover 9 prevents white aluminum oxide 5 from blowing out of chamber 7. Hollow cylinder 10 allows air to exhaust chamber 7. Upper payload section 12 and lower payload section 13 are joined by seal area 8. Upper payload section 12 and lower payload section 13 come apart at seal area 8. Lower payload section 13 is removed off of blower 2 and emptied at that point. Rubber banding 14 is used to hold upper payload section 12 and lower payload section 13 together. Vent 15 is connected to hollow cylinder 10 to vent air from blower 2. To operate the device, door 8 is opened and the white aluminum oxide 5 along with the commercial/domestic plastic fingernail extensions 6 are loaded into chamber 7. Next, electrical cord 1 is connected to electrical power for about one and a half hours. During this time, air is blown through chamber 7 mixing the white aluminum oxide 5 and the commercial/domestic plastic fingernail tip extensions 6 which roughens/scratches the surfaces of the commercial/domestic plastic fingernail tip extensions. After the power is removed from blower 2, door 8 is opened and the commercial/domestic plastic fingernail tip extensions are unloaded.

What is claimed is:

1. Process for modifying a commercial/domestic plastic fingernail tip extensions comprising the steps of:

(a) loading an abrasive material with a plurality of commercial/domestic plastic fingernail tip extensions into a mixing chamber whereby the plurality of fingernail tip extensions are processed simultaneously;

(b) blowing gas through said mixing chamber in combination with an abrasive material to scratch/roughen said commercial/domestic plastic fingernail tip extensions to a desired thickness;

(c) unloading said commercial/domestic plastic fingernail tip extensions.

2. Process for modifying a commercial/domestic plastic fingernail tip extensions comprising the steps of:

(a) loading an abrasive material with a plurality of commercial/domestic plastic fingernail tip extensions into a mixing chamber whereby a plurality of fingernail tip extensions are processed simultaneously;

(b) tumbling said mixing chamber to scratch/roughen said commercial/domestic plastic fingernail tip extensions to a desired thickness;

(c) unloading said commercial/domestic plastic fingernail tip extensions.

3. Process for modifying a commercial/domestic plastic fingernail tip extensions comprising the steps of:

(a) loading an abrasive material with a plurality of commercial/domestic plastic fingernail tip extensions into a mixing chamber whereby a plurality of fingernail tip extensions are processed simultaneously;

(b) vibrating said mixing chamber to scratch/roughen said commercial/domestic plastic fingernail tip extensions to a desired thickness;

(c) unloading said commercial/domestic plastic fingernail tip extensions.

* * * * *